United States Patent [19]

Thorsheim

[11] 4,065,117

[45] Dec. 27, 1977

[54] METHOD AND AN APPARATUS FOR ADDRESSING AND STACKING INDIVIDUAL PIECES OF PRINTED MATTER FOR MAILING, ESPECIALLY MAGAZINE COPIES, BOOKLETS AND OTHER BINDERY ARTICLES

[76] Inventor: Ivar Thorsheim, Kalkfjellet 15, 1370 Asker, Norway

[21] Appl. No.: 689,844

[22] Filed: May 25, 1976

[51] Int. Cl.[2] ..... B65H 39/02

[52] U.S. Cl. ..... 270/58; 93/93 R; 214/6.5

[58] Field of Search ..... 270/52, 54–58; 93/93 R, 93 M, 93 C, 93 DP; 101/2, 426; 214/6.5

[56] References Cited

U.S. PATENT DOCUMENTS

| | | | |
|---|---|---|---|
| 3,364,827 | 1/1968 | Schmitz | 93/93 R |
| 3,507,211 | 4/1970 | Kirk | 93/93 R |
| 3,593,624 | 7/1971 | Dufour | 93/93 DP |
| 3,608,888 | 9/1971 | McCain | 270/54 |
| 3,917,252 | 11/1975 | Harder | 270/58 |

*Primary Examiner*—Edgar S. Burr
*Assistant Examiner*—A. Heinz
*Attorney, Agent, or Firm*—Watson, Cole, Grindle & Watson

[57] ABSTRACT

A method and an apparatus for addressing and stacking individual pieces of printed matter for mailing, especially magazine copies, booklets and other bindery articles. The addressing of the mailing pieces is accomplished by applying to each mailing piece individual address identification data, such as labels from a computer-printed address list. After addressing of the mailing pieces has been accomplished, the labelled or identified pieces are conveyed into one or more stacking machines, the front page and the back of each magazine being oriented in the same direction. Each of the stacking machines is equipped with a first selector for changing the orientation of the mailing pieces so as to stack the mailing pieces in batches comprising a selected number of pieces, the copies of each batch having their backs oriented the same way, but oppositely of the backs of the pieces in the underlying batch. Each stacking machine also comprises a second selector for initiating removal of a full pile of such oriented mailing pieces. When a printed address list is used, a detection of symbols thereon is accomplished prior to the severing of the computer list into individual address labels. Depending on the combination of the detected symbols, the detector and control systems initiate operation of the first and/or second selectors. The symbols and combinations thereof are positioned on the printed address lists or on the storage means in dependence of the number of mailing pieces to be delivered to one post office or one zip code. The method and the apparatus allow for stacking of the mailing pieces so as to make the stack or pile upright despite the normally increased thickness of the backs of the pieces and without introducing any discontinuation in the stacking or removing operation of the piles.

15 Claims, 5 Drawing Figures

METHOD AND AN APPARATUS FOR ADDRESSING AND STACKING INDIVIDUAL PIECES OF PRINTED MATTER FOR MAILING, ESPECIALLY MAGAZINE COPIES, BOOKLETS AND OTHER BINDERY ARTICLES

BACKGROUND OF THE INVENTION

The present invention relates to a method and an apparatus for addressing and stacking individual pieces of printed matter for mailing, such as sheets of paper, magazine copies, booklets and other bindery articles.

Addressing machines are generally designed to apply address labels from computer-printed stationary (multi-form) onto envelopes or other mailing material. The stationary, which may have different widths, can be printed in any number of columns, generally from one to five, and the vertical spacing from the start of one address to the next can be varied as desired.

The printed form is perforated or cut between the columns and then a complete horizontal strip of names and addresses is guillotined. A burster section separates the strip into individual address labels before applying each one to a mailing piece. The burster section may be connected to an electronic photocell device located in front of the feeder, so that the burster will release an address label only upon detection of a mailing piece.

Such addressing machines may be equipped with a zip code reader for group separation and an adjustable batch counter enabling the machine to batch in any quantity within a given range. The batches may be collected onto an intermittently driven conveyor belt, and upon reaching a given batch quantity, the conveyor belt may be advanced an appropriate step for providing fresh conveyor space on which the next batch may be collected.

However, such labelling machines alone are not able to change the orientation of the mailing pieces so as to stack, e.g. copies of magazines, in stacks or piles comprising batches of copies, the copies of each batch having their backs oriented the same way, but oppositely of the underlying batch, so as to make the stack or pile upright despite the normally increased thickness of the back of the copies.

An addressing machine to be used in connection with such printed matter must therefore be installed together with, or in line with, a stacking machine provided with means for performing this type of stacking, so as to build up a naturally vertical pile of copies before the latter is packed and forwarded for distribution to its destination.

Various types of stacking machines are known and are available on the market. A first type of stacking machine comprises a feeding conveyor for feeding magazine copies or the like to a stacking section having a lowerable and turnable support for receiving the copies thereonto. When a given number of copies, i.e. a batch of copies, has been stacked on the support, a signal initiated by a counter means initiates discontinuation of the feeding operation and initiates operation of the turning movement of the support by 180°. On completion of the turning movement, the conveyor regains its feeding operation until another batch has been piled up on the previous one.

Upon completion of a full pile, a signal originating from the same counter means initiates removal of the pile, simultaneously as the signal instructs the feeding mechanism to be discontinued. As will be understood, a stacking machine of this type has the disadvantage of interrupting the feeding operation each time the batches are turned and each time a pile is removed from the machine.

A second type of stacking machine comprises a feeding conveyor for feeding magazine copies or the like to the top of a stacking chamber having a lowerable and hoistable support for receiving the copies in a pile. The copies are delivered one by one at a relatively high speed and may be fed to the stacking chamber with their backs oriented differently. In the stacking chamber the copies are arranged in a naturally balanced pile which, when completed, is pushed out from the stacker, whilst the next continually delivered copies which are to form the next pile are collected temporarily in a recipient and therefrom delivered to the support for the pile as soon as the support is cleared of the previous pile.

The present invention has therefore been developed in connection with a stacking machine in which the stacking of mailing pieces, i.e. magazine copies or the like, may be accomplished in the above-described manner without introducing any discontinuation in the stacking or removing operation of the piles.

SUMMARY OF THE INVENTION

An object of the present invention is therefore to provide a method for addressing and stacking mailing pieces of the type referred to above, but in which a naturally vertical pile of copies may be built up in a very rapid manner without incurring any interruption of the feeding of copies which are continually delivered to the stacking machine.

Another object of the present invention is to provide a method in which the batches constituting the piles are selected so as to correspond to the zip code or post office to which the pile is destined.

A further object of the invention is to provide an apparatus for performing this addressing and stacking method in a very rapid and non-interrupted manner.

The method according to the present invention is characterized by the following steps:

a. the address identification data are applied to each mailing piece from computer-processed recording means, the application of the individual address data being accomplished by means of a data record-forming means, b. the such labelled mailing pieces are conveyed one by one to at least one stacking machine, the pieces entering the stacking machine with the front page and the back of each mailing piece oriented in the same direction, the stacking machine comprising first selector means for changing the orientation of the mailing pieces so as to stack the mailing pieces in batches comprising a selected number of pieces, the copies of each batch being oriented the same way, but oppositely of the backs of the pieces in the underlying batch, and the stacking machine also comprising second selector means for initiating removal of a full pile of such oriented mailing pieces, and c. that signals initiating operation of said first selector means, and signals initiating the operation of the second selector means, are generated by detector means which are adapted to detect given symbols located on the computer processed recording means, and which upon detection of a given combination of symbols generate signals for initiating operation of the first and/or the second selector means.

In accordance with a preferred embodiment of the invention the method is characterized by the following steps:

a. the address labels are applied to each mailing piece from computer-printed continuous stationary, the addresses being printed in a given number of columns on the stationary which is guillotined in transverse strips comprising one address from each column, and which strips are separated into individual address labels before being applied to each mailing piece, b. the such labelled mailing pieces are conveyed one by one to at least one stacking machine, the pieces entering the stacking machine with the front page and the back of each mailing piece oriented in the same direction, the stacking machine comprising first selector means for changing the orientation of the mailing pieces so as to stack the mailing pieces in batches comprising a selected number of pieces, the copies of each batch being oriented the same way, but oppositely of the backs of the pieces in the underlying batch, and the stacking machine also comprising second selector means for initiating removal of a full pile of such oriented mailing pieces, and c. signals initiating operation of said first selector means, and signals initiating the operation of the second selector means are generated by detector means which are adapted to detect given symbols located on the computer printed stationary, and which upon detection of a given combination of symbols generate signals for initiating operation of the first and/or the second selector means.

This method is particularly favorable when applied directly to the outfeed line of a printing machine or trimmer. Usually the printing machine may produce copies at a very high rate, whereas the stacking machines are designed to cope with a smaller number of copies per hour. However, by arranging two or more stacking machines at the outfeed line of the printing machine and by arranging all stacking machines in accordance with the present invention, a very efficient and rapid addressing and stacking system may be achieved, the finished piles constituting addressed and appropriately sorted mailing pieces which are oriented not only according to zip code or post offices, but also oriented so as to provide compensated or naturally vertical piles of copies, and which are ready to be despatched to their places of destination.

Of course, the method according to the invention may also be used in connection with mailing pieces which have been temporarily stored on pallets or the like, and which have been fed therefrom to the stacking machines in the manner described above. However, by utilizing the method according to the invention in connection with a stacking machine arranged in line with the printing machines or/and trimmer, the temporary storing with its space requirement may be dispensed with.

An apparatus according to the invention is characterized in that it comprises:

a. a computer for processing address identification data and storing same on a record medium, the computer being programmed so as to collect addresses belonging to the same postal code or zip code in batches, the batches being identified by means of the symbols being dependent upon the number of addresses belonging to the same batch, b. an addressing machine adapted to apply the address identification data onto individual mailing pieces which pass the addressing machine in a row wherein each piece has the front page and the back page oriented in the same direction, c. a stacking machine comprising an infeed conveyor adapted for transporting the row of addressed mailing copies from the addressing machine, the stacking machine further comprising first selector means for changing the orientation of the mailing pieces so as to stack the mailing pieces in batches comprising a selected number of pieces, the copies of each batch having their backs oriented in the same way, but oppositely of the backs of the pieces in the underlying batch, and the stacking machine also comprising second selector means for initiating removal of a full pile of such oriented mailing pieces, d. detector means adapted to detect the symbols on the record medium, the detector means, upon detection of a given combination of symbols, generating signals for initiating operation of the first and/or second operating means.

BRIEF DESCRIPTION OF THE DRAWINGS

In the following the invention will be described in more detail, reference being had to the accompanying drawings.

DETAILED DESCRIPTION OF THE INVENTION

Figure 1:
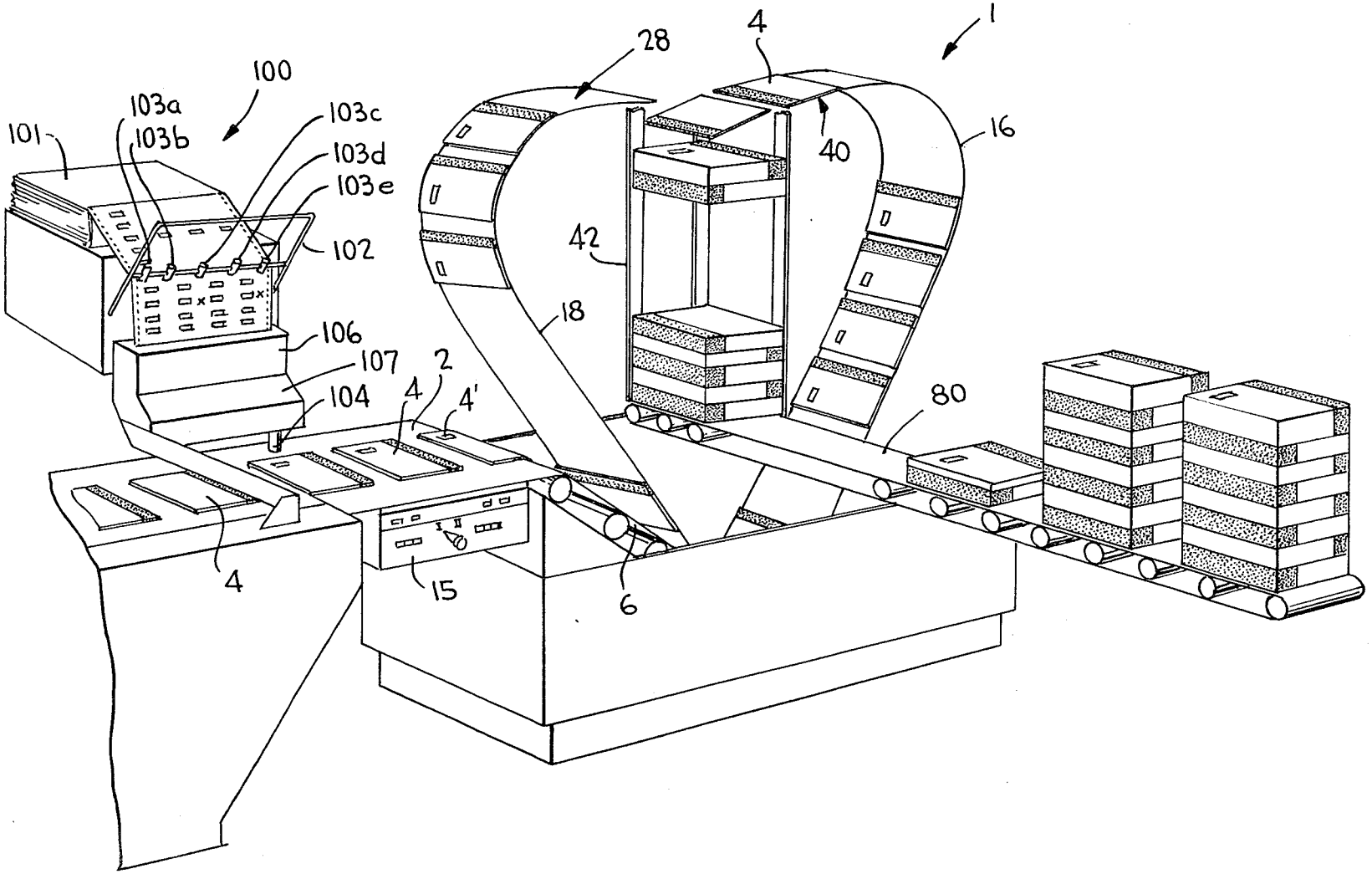
FIG. 1 is a diagrammatic perspective view illustrating the major parts comprised in a preferred embodiment of the apparatus according to the present invention and also illustrating piles of addressed mailing pieces sorted in accordance with a first embodiment of the method according to the present invention.
Figure 2:
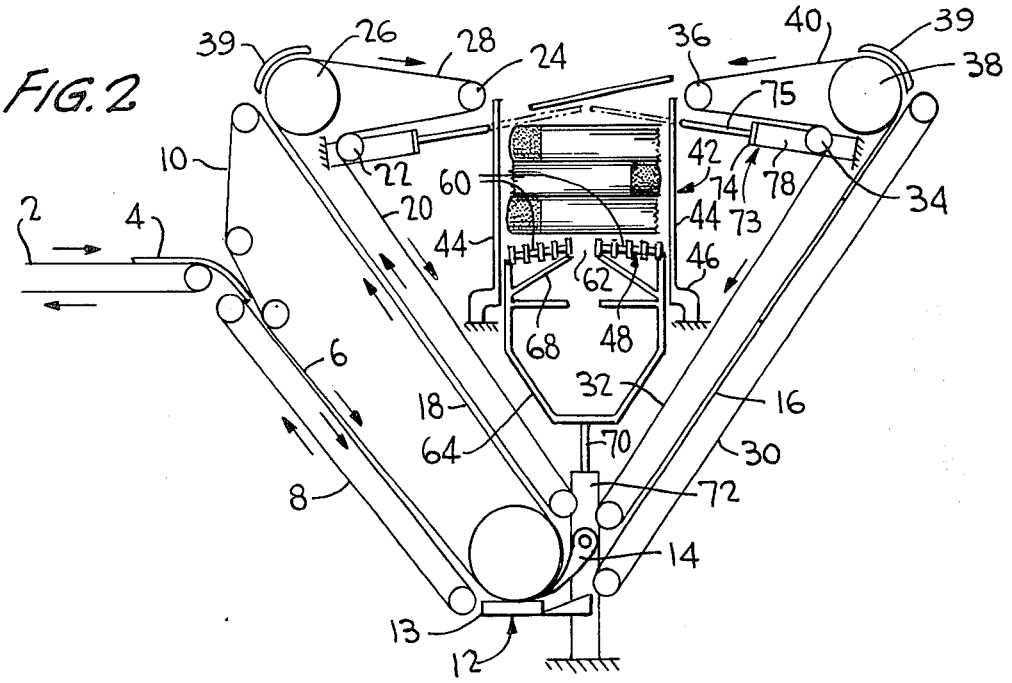
FIG. 2 is a diagrammatic sectional view of a preferred embodiment of a stacking machine.

The apparatus shown in FIG. 1 comprises a stacking machine which is generally designated by 1, and which is shown in further details in FIG. 2. Since the perspective view in FIG. 1 is very simplified, only some of the designation numbers of FIG. 2 will be found in FIG. 1. The stacking machine as shown in FIGS. 1 and 2 comprises an inlet conveyor 2 on which magazine copies 4 or the like are supplied to a conventional double-sided belt conveyor 6 constituted by juxtaposed portions of endless belts 8 and 10 (FIG. 2). The conveyor 6 is downwardly inclined and brings the copies 4 consecutively down to a track-shifting station generally designated 12 adjacent to the bottom of the stacker. In this station 12 a track-shifting member 14 is pivotably mounted so as to guide the copies into either of two oppositely inclined upwardly directed double belt conveyor sections 16 and 18, respectively, the selected conveyor in the position of the shifting member 14 shown in FIG. 2 being the conveyor 16. The track-shifting station 12 comprises a counting device 13 which by means of a suitable detector means, e.g. a photocell device, registers the number of copies 4 which have passed the track-shifting mechanism 12, the counting device 13 being connected to control unit 15 designed for operatively influencing the track-shifting member 14 so as to cause this member to be switched over every time a given number of copies has passed the station, this number being determined by the control unit as will be described in more detail in the following. If this given number is, e.g. fourteen, the first fourteen copies will be transferred to conveyor 16, and if the next number of predetermined copies is also fourteen, the next fourteen copies will be transferred to the second conveyor 18. Thereafter the next number of predetermined copies will be transferred to the first conveyor 16 and so forth, as will be described later.

The double belt conveyor 18 is constituted by the belt 10 at the one side and by a belt 20 at the other side, the belt 20 being guided by means of rollers 22, 24, 26 so as to form an inwardly directed delivery conveyor section 28 adjacent the top of the machine. In a corresponding manner the conveyor 16 is constituted by a belt 30 at one side and a belt 32 at the other side, the belt 32 passing rollers 34, 36 and 38 so as likewise to constitute an inwardly directed conveyor section 40 adjacent the top of the stacking machine 1.

In order to guide the magazine copies 4 from the conveyor 18 to the conveyor section 28, or respectively from the conveyor 16 to the conveyor section 40, there is provided an arched plate member 39 outside each of the two rollers 26 and 38.

The different belts referred to above are driven in the directions of the arrows shown in FIG. 2.

Between and underneath the free delivery ends of the upper conveyor sections 28 and 40 there is arranged a copy-receiving chamber generally designated 42. This receiving chamber 42 has opposite framework walls or plate-formed side walls 44 carried on a supporting chassis 46. The side walls are provided with means (not shown) so as to be adjustable to bring the mutual distance therebetween in accordance with the breadth of the magazine copies 4. In this connection it should be noted that the copies 4 are fed to the stacking machine with their back portions as the leading edge, so that when the copies are delivered to the top of the stacking chamber 42 from one of the conveyor sections, i.e 28 or 40, the back will still be the leading edge of the copies, whereby the distance between the chamber walls 44 will correspond to the breadth of the magazine copies. Suitable height-guiding members (not shown) are also included, these guiding members being adjustable to correspond to the height of the magazines being piled in the receiving chamber. In the drawings the back portion of each magazine copy is for illustration purposes given a darker color than the remaining cover pages of the copy.

The bottom of the chamber 42 is constituted by a vertically movable roller support generally designated 48 and consists of two roller carrying frames 60, each mounted in a slightly inwardly-upwardly inclined position with a central slot 62 therebetween, these frames being mounted on the top ends of a pair of fork members 64, the innermost edges of the frames 60 being supported by means of stays 68 projecting from the outer portions of the fork members 64. The fork members 64 are mounted on piston rods 70 for a pair of workings cylinders 72 rigidly mounted on the chassis 46. Thus, the support 48 may be raised and lowered by means of the cylinders 72.

Adjacent to the top of the chamber 42, but at a level underneath the delivery ends of the conveyor sections 28 and 40, there is on each side mounted a grate member 73 comprising a base member 74 and a number of carrier rods 75. The base member 74 at each side of the chamber 42 is mounted at the outer end of a pair of piston rods (not shown) for cylinders 78, these cylinders being a rigidly associated with the chassis 46 by means of suitable connection elements. Thus, by means of the cylinders 78 the grate member 73 is mounted for substantially horizontal movement so as to be movable between the projecting position shown in FIG. 2 in dotted lines and in a retracted position shown in full lines in the same figure and in which the rods 75 are positioned entirely outside the stacking chamber 42. This latter position is assumed during normal operation of the stacker. It is to be understood that in the extended position of the rods 75 they project through notches (not shown) in the top side of the chamber walls 44.

The mode of operation of the machine is as follows: In the starting position the bottom support member 48 is raised to a position immediately underneath the level of the rods 75, and these rods are in their retracted positions as shown in full lines in FIG. 2. Magazine copies 4 are supplied from the conveyor 6, and with the shift member 14 in the position shown, the magazines will move up through the conveyor 16 and be thrown out consecutively into the chamber 42 from the delivery conveyor section 40 a short distance above the bottom member 48 so as to fall to rest thereon while being guided by the side walls 44 and the above-mentioned (not shown) magazine height-guiding members. The cylinders 72 are actuated by appropriate means so as to lower the support 48 according to the rate of growth of the pile thereon, so that the top of the pile of magazines which is formed will remain at a level shortly underneath the level at which the magazines are thrown into the chamber. This lowering of the support may, of course, be effected at the correct rate when the rate of growth of the pile, as determined by the rate of supply of the magazines, is known, but in practice it is preferred to automatically operate the cylinders to lower the support in response to the pile growing above a predetermined top level. This level may be detected by a feeler means, such as a photocell, which together with a cooperating lamp is arranged at the top of the chamber 42. In a manner as known per se it will hereby be possible to connect the photocell in a control circuit so as to cause the support 48 to be lowered every time or as long as the photocell registers the presence of a magazine in or above its own level.

The counting device 13, which is mounted on the conveyor line in the area of the shift member 14, may, in connection with a signal generated by the control unit 15, register a predetermined number of copies of magazines 4 which have passed the station 12. Upon registration of this predetermined number together with the command signal, a shift signal is generated by the control unit. The shift member 14 will then automatically be shifted over so as to guide the following magazines to the conveyor section 18 and further to the conveyor section 28 for delivery at the opposite side of the chamber 42. The following predetermined number of magazines will now be piled up on the top of the pile already present on the support 48, but with opposite orientation of the magazine backs so that a naturally vertical pile is built up. In this manner several batches containing a predetermined number of magazines alternately oriented in the chamber 42 will be deposited in a pile on the support 48 while this is being lowered.

When the support 48 reaches its bottom position in level with an outfeed conveyor which in FIG. 1 is generally designated 80, switch means (not shown) is operated by an appropriately located actuator. This switch means is connected so as to cause actuation of a pole-shaped pusher member (not shown) and a driving motor for the outfeed conveyor 80. The pusher member is adapted to operate in the slot 62 between the roller-carrying frames 60 for moving the pile of magazines out of the collection chamber 42 and onto the outfeed conveyor 80. Simultaneously with the operation of the pusher member, the grate members 73 are rapidly brought into their support position as shown in dotted lines in FIG. 2. The delivery of magazines from either conveyors 28 or 40 is not interrupted as the stacked pile is moved forward along the outfeed conveyor 80, the following magazine copies being piled up on the rods 75 of the grates 73, which thereby act as a temporary support for the magazine copies.

When the conveyance of the finished pile has reached so far that space is available in the area of the support 48, the cylinders 72 will raise the support 48 rapidly and as soon as the support 48 has reached its top position immediately underneath the rods 75, the cylinders 78 are automatically operated so as to retract the carrier rods 75 from their projecting position, whereby the magazines piled up thereon during the described outfeed operation will fall down onto the support 48, whereafter the piling operation will continue in the same manner as described above. The actuation of the cylinders 78 may be effected in response to a switch which is actuated when the support 48 reaches its top position, the switch being located at an appropriate level in the area of the infeed section of the collection chamber 42. It is to be understood that the pusher member is retracted simultaneously with the raising of the support 48.

Figure 3:
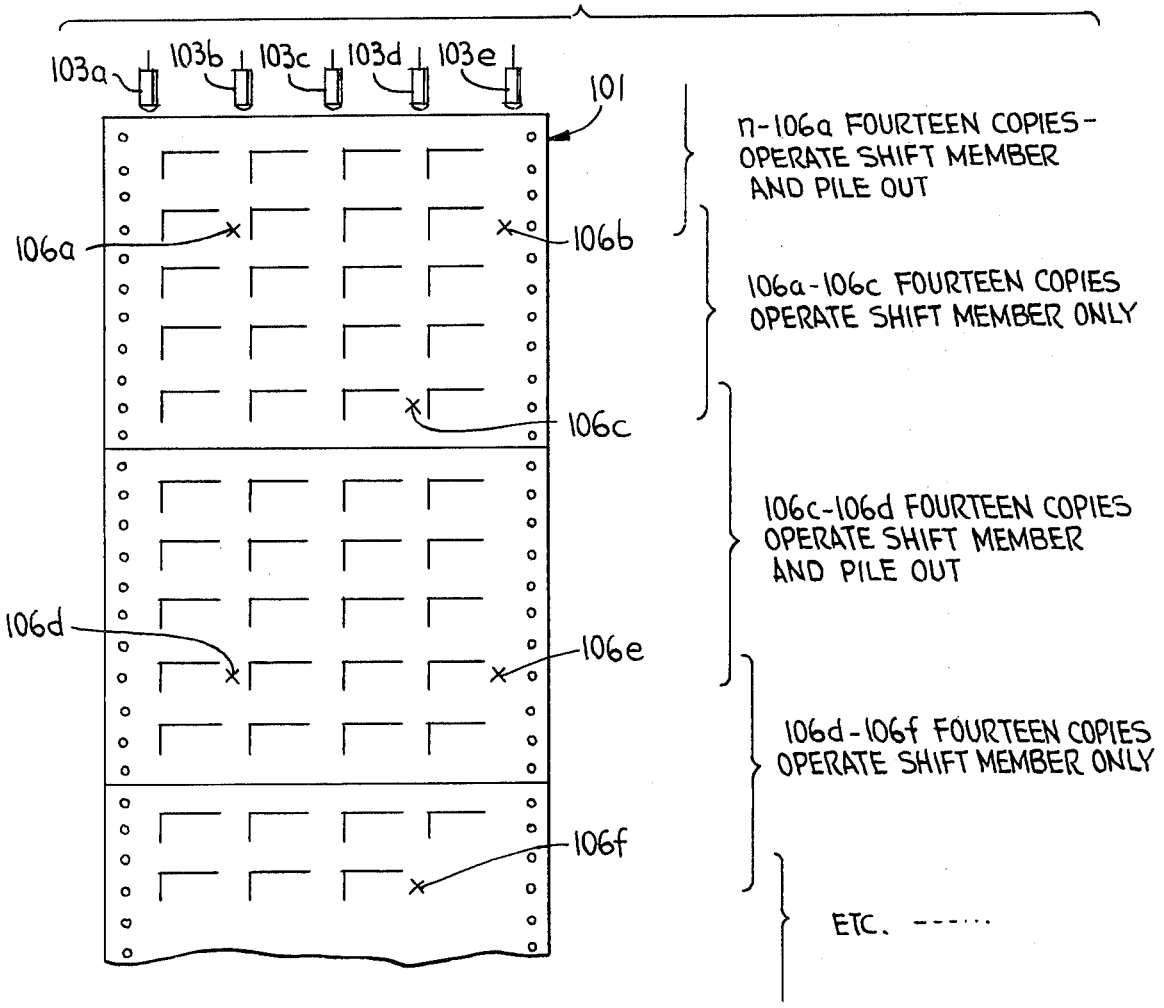
FIG. 3 shows on a larger scale three forms of an addressing list printed and marked in accordance with the present invention.

As indicated in FIG. 1, the apparatus according to the invention also comprises an addressing machine generally designated 100. The addressing machine 100 is designed to apply address labels from computer-printed stationary (multiform) onto mailing pieces such as booklets, magazine copies and other bindery articles. Stationary 101 is located on top of the addressing machine 100, and this stationary has, prior to being positioned at the indicated location on the addressing machine, been printed with names and addresses of the addressees to which the mailing pieces are to be mailed. The printing of the stationary may be accomplished in any number of columns and as indicated in FIGS. 1 and 3, four columns may be appropriate. The printed form is guided past a support frame 102, onto which is adjustably mounted five detector means 103*a* – 103*e*, the purposes of which are to detect symbols which according to a computer program have been marked or printed between the columns of addresses. The detector means 103*a* – 103*e* are wired to the control unit 15, the control unit 15 also receiving signals from another detector means 104 located at a position where it can detect finished labelled magazines which have passed the addressing machine 100.

Figure 5:
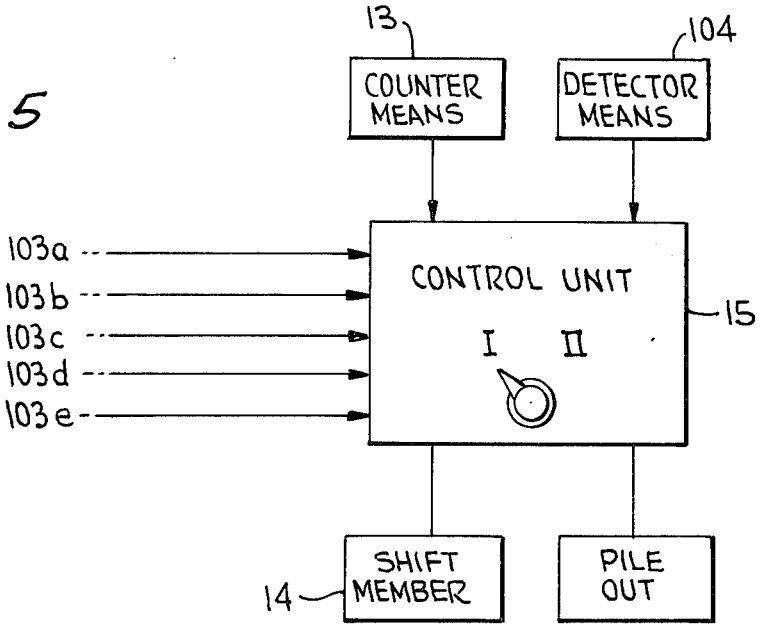
FIG. 5 is a block diagram of the control circuit of the apparatus shown in FIGS. 1 and 2.

As indicated in FIG. 5, the control unit 15 thus receives signals from the detector means 103*a* – 103*e*, the detector means 104 and the previously discussed counter 13. The function of this control unit 15 will be further discussed later.

After having passed the detector means 103*a* – 103*e*, the printed form is perforated or cut between the columns and then complete horizontal strips of names and addresses are guillotined, the operations being accomplished in a stripping unit as indicated at 106. A burster section as indicated at 107 separates the strips into individual address labels 4' before applying them one by one to separate mailing pieces 4 which are continually conveyed to the addressing machine 100 via the infeed conveyor belt 2. The burster section 107 may suitably be connected to the detector means 104 located in front of the label feeder, so that the burster section will release an address label 4' only upon detection of a mailing piece 4.

In FIG. 3, which on a larger scale illustrates three forms of an address list 101 printed by a computer in accordance with the present invention, it is seen that each of the detector means 103*a* – 103*d* is located in front of the identification data of an addressee, i.e., the detector means 103*a* is adapted to read marks or symbols which are located in the area to the left of column No. 1, the detector means 103*b* being adapted to read symbols located between column 1 and column 2 and so on, whereas the detector means 103*e* to the extreme right is adapted to read symbols printed at the right hand edge of the computer form.

In FIG. 3 the symbols are indicated as crosses and the the symbols or crosses 106*a* – 106*f* have been located at their predetermined locations as a result of a computer program which is able to data process the names and addresses depending on the number of addressees belonging to the same zip code or post office.

In other words the symbols 106*a* – 106*f* and so on are printed between and on either side of the columns of addresses simultaneously with the printing of the addresses.

When the total number of mailing pieces to be delivered to a post office or a zip code is larger than a given number, i.e. fourteen, the symbols 106*a* . . . are positioned so as to initiate operation of the shift member 14 whenever the number of mailing pieces or multiples thereof have entered the stacking machine 1. When the total number of mailing pieces to be delivered to the zip code has been reached, the outfeed conveyor means 80 will be operated so as to remove the pile from the stacking machine for further distribution to the zip code.

In other words, whenever one of the detector means 103*a* – 103*d* detects a symbol in front of the first column of addresses or between any column of addresses, respectively, such as the symbol 106*a*, 106*c*, 106*d*, 106*f*, as indicated in FIG. 3, a signal will be generated in the control unit 15 so as to operate the shift member 14 for thereby transferring the addressed copies 4 conveyed to the stacking machine 1 from the conveyor section 18 to the conveyor section 16 or vice versa. If an edge symbol, such as signal 106*b*, is registered by detector means 103*e* at the same time as detector means 103*b* detects symbols 106*a*, another signal is generated in the control unit 15 so as to operate the outfeed conveyor means 80, thereby finishing off a pile consisting of copies which have attached thereto address labels which are located on the computer stationary prior to the symbol 106*a*.

As the above-mentioned pile is being removed from the support 48 and pushed onto the outfeed conveyor 80, another pile is being formed on the above-described auxiliary support members 73, this new pile according to the list illustrated in FIG. 3 consisting of a first batch of 14 copies defined by the addresses between symbols 106*a* and 106*c*, and a second batch defined by the addresses between symbols 106*c* and 106*d*. The copies constituting the first batch of the new pile will arrive in the stacking chamber 42 with their address labels down, and when symbol 106*c* is read by detector means 103*d*, a signal is generated in the control unit 15. This signal initiates operation of the shift member 14 after the first 14 copies of the new pile have passed the track-shifting station 12, for thereby changing the orientation of the next 14 copies, i.e., the copies defined between symbols 106*c* and 106*d*, the latter copies arriving at the top of the pile with their address labels up. In the line of addresses wherein symbols 106*d* and 106*e* are printed, both selector means 103*b* and 103*e* will apply a signal to the control unit 15 which when the appropriate number of copies have passed the station 12, once again will initiate operation of the shift member 14. When the copy having the address label right ahead of symbol 106*d* has reached the top of the above-described pile, this pile will consist of the two batches of magazines, which batches have their backs oppositely oriented so as to form a naturally balanced pile. Simultaneously, the control unit 15 generates a signal for operating the outfeed conveyor 80 for removing the finished pile from the area of the stacking chamber 42. It is to be understood that also during this outfeed operation of the finished pile the auxiliary support member 73 has been in operation so as to support the next pile and hence avoid discontinuation of the feeding operation of the magazines into the stacking machine.

The above-described pile consisting of two batches of copies is now ready for packing, and due to the orientation of the individual copies, i.e., since the address labels of the top and bottom mailing piece are visible both from the top or the bottom, no further labels are necessary to indicate to which zip code this pile is to be shipped.

Of course, the number of batches constituting one pile may be different from two, which number in the above-described case is only used as an example. The number of batches may be an arbitrary number depending on how many copies are alotted for each batch, but it should be observed that in the case where the total stack or pile is for one post office or zip code, the number of batches should be selected so that the bottom piece of a pile and the top piece of a pile have their address label visible from the top and the bottom. This facilitates the distribution as no further destination label has to be attached to the pile.

In FIG. 1 the finished piles which leave the outfeed conveyor 80 are all to be dispatched to their own post office or zip code, the selection of such piles being determined by the computer program in which the number of batches and the number of copies contained therein may be appropriately determined so as to form naturally balanced piles having top and bottom copies with address labels turned outwardly for easy identification.

Figure 4:
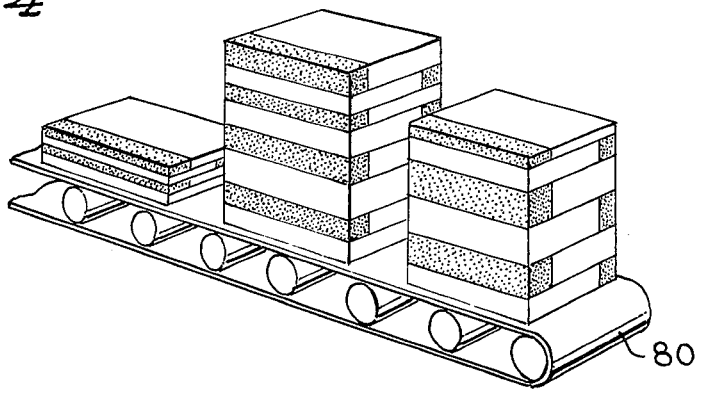
FIG. 4 is a diagrammatic perspective view of an outfeed conveyor from the stacking machine, on which conveyor is transported piles of addressed mailing pieces sorted in accordance with a second embodiment of the method according to the present invention.

FIG. 4 is a perspective view of the outfeed conveyor 80 from the stacking machine 1. This conveyor transports piles of addressed mailing pieces sorted in accordance with another computer program which constitutes a variation of the method according to the present invention. In this case the total number of mailing pieces to be delivered to a post office or a zip code is smaller than a given number, i.e., smaller than fourteen. When the appropriate number of mailing pieces belonging to a first zip code has been collected in one batch, another containing pieces belonging to a second zip code will be formed in order to provide a naturally stabilized pile. The symbols or marks corresponding to the above-described symbols 106 . . . will also in this case be printed between and on either side of the columns of addresses and the printing thereof will be accommodated simultaneously with the printing of these addresses. However, the number of copies between every shift will not be a fixed number as in the above case when the total stack or pile was destined for one post office, but will be a number corresponding to the number of copies to be delivered to one special zip code or one post office. In this case, however, the bottom and the top copy of a pile should not be located so as to make their address labels visible. On the contrary, the batches should be so orientated that the address labels should not be visible neither from the top nor from the bottom. However, when a complete pile has been formed and before the packing thereof is accomplished, the pile is provided with a special label indicating the postal route of said pile.

Of course, the system described above, i.e., the addressing system depending on whether the finished piles belong to one post office or zip code or if each batch is for one post office, may be applicable to other stacking machines than the one described above. However, the system is particularly favorable in connection with the above-described stacking machine as this machine may change the orientation of each copy without interrupting the infeed operation thereto. Depending on the position of the shift member 14, the magazines passing the station 12 may automatically be guided to either top side of the selection chamber 42. The copies arrive at the common inlet end of the two sloping conveyors 16 and 16, respectively, of the stacking machine with the back of the copies orientated uniformly for all copies. According to the invention a number of consecutive copies are transferred to the first of these conveyors and thereafter a number of consecutive copies are transferred to the other conveyor, the number of copies to be delivered to either conveyor depending on the symbols printed on the address list. The copies delivered from the first conveyor 16 are stacked in a pile on a preferably horizontal support with their backs orientated in one direction, whereas the copies delivered via the other conveyor 18 are deposited on top of said first pile with their backs oriented in the opposite direction.

It should be noted that a variation of the stacking machine described above may constitute a track-shifting mechanism which is located in relation to the conveyor belts so as to feed the individually oriented magazine copies onto a common conveyor which delivers the oriented copies to the collection chamber from one top side only.

Further, it should be noted that the inventive idea is not bound to the application of address labels prepared from computer-printed lists. The method according to the present invention is also applicable whenever the computer-processed address identification data have been recorded on any suitable record medium. By means of the computer program the addresses belonging to the same zip code or post office may be collected in batches and the batches may be collected in batches and the batches may be detectable by means of symbols recorded at appropriate locations on the record mediums. The addressing machine to be used in connection with a record medium may then be of a type which directly converts the identification data into readable characters, the characters being applied directly to the front or rear page of the mailing piece. The detector means for detecting the recorded symbols will detect the symbols directly from the record medium and upon detection of these signals apply signals to the control unit. The control unit will then depending on the combination of symbols, operate as described above, i.e., control the changeover function of the track-shifting member and the pile out operation.

What I claim is:

1. A method for addressing and stacking individual pieces of printed matter for mailing, such as sheets of paper, magazine copies, booklets and other bindery articles wherein each mailing piece has a back, comprising the steps of:

a. applying individual address identification data to each mailing piece from computer-processed recording means, the application of the individual address data being accomplished by means of data record-forming means;

b. conveying such labelled mailing pieces one by one to at least one stacking machine, said pieces entering said stacking machine with the address label and the back of each mailing piece oriented in the same way, said stacking machine including a stacking chamber for receiving said articles, first and second conveying means each having an inlet and an outlet, said first and second outlets each associated with a respective opposite side of said stacking chamber, and a shift member adapted for diverting predetermined numbers of pieces to either said inlet of said first conveying means or said inlet of said second conveying means;

c. operating said shift member, the operation of said shift member being in response to a first set of symbol combinations stored at appropriate locations in said computer-processed recording means so as to stack the mailing pieces in batches comprising a selected number of pieces, the backs and the address labels of the pieces of each batch being oriented the same way, but oppositely of the backs of the pieces in an underlying batch, based on the said conveying means on which the pieces are conveyed;

d. operating a selector means for initiating removal of a full pile composed of a plurality of batches of such oriented mailing pieces, the operation of said selector means being in response to a second set of symbol combinations stored at appropriate locations in said computer-processed recording means.

2. A method for addressing and stacking individual pieces of printed matter for mailing, such as sheets of paper, magazine copies, booklets and other bindery articles wherein each mailing piece has a back, comprising the steps of:

a. applying address labels to each mailing piece from computer-printed continuous stationary, the addresses being printed in a given number of columns on said stationary which is guillotined into strips comprising one address from each column, and which strips are separated into individual address labels before being applied to each mailing piece;

b. conveying such labelled mailing pieces one by one to at least one stacking machine, said pieces entering said stacking machine with the back and address label of each mailing piece oriented in the same way, changing the orientation of said mailing pieces with a shift member so as to stack the mailing pieces in batches of a selected number of pieces, stacking the copies of each batch having their backs and address labels oriented the same way, but oppositely of the address labels and the backs of the pieces in an underlying batch, and said stacking machine also comprising a selector means for initiating removal of a full pile composed of a plurality of batches; and c. initiating operation of said shift member and initiating the operation of said selector means in response to signals generated by detector means which detects given symbols located on said computer-printed stationary and which upon detection of a first set of said symbol combinations generates signals for initiating operation of said shift member to form said batches of pieces and which upon detection of a second set of said symbol combinations generates operation of said selector means for initiating removal of said full pile of pieces.

3. A method as claimed in claim 2, wherein said symbols are printed between and on either side of said columns of addresses on said computer-printed stationary, the printing of said symbols being accomplished simultaneously with the printing of said addresses.

4. A method as claimed in claim 3, wherein the position of said symbols is determined by the number of mailing pieces to be delivered to one post office or one zip code.

5. A method as claimed in claim 4, wherein the total number of mailing pieces to be delivered to one post office or one zip code is larger than a given number, said symbols being positioned such that said shift member is operated whenever said number of mailing pieces or multiples thereof have entered said stacking machine, and such that said selector means is operated whenever said total number of mailing pieces belonging to said zip code has been conveyed into said stacking machine.

6. A method as claimed in claim 5, wherein said symbols are positioned in the address stationary such that said shift member for thereby orienting the bottom piece of pile and the top piece of a pile is operated so that the address labels of said top and bottom pieces are visible from the top and the bottom respectively.

7. A method as claimed in claim 6, wherein the total number of mailing pieces to be delivered to a post office or a zip code is smaller than a given number, said symbols being positioned such that said shift member is operated whenever said smaller number of mailing pieces has entered said stacking machine, and such that said selector means is operated whenever a total number of such oriented mailing pieces exceeds a predetermined pile number.

8. A method as claimed in claim 7, wherein said shift member is operated such that the number of batches in one complete pile is an even number, the bottom and the top mailing piece thus having their address label turned inwardly.

9. A method as claimed in claim 7, including the step of providing a special label indicating the postal route onto said complete pile before or upon leaving the stacking machine.

10. Apparatus for stacking individual pieces of printed matter for mailing, such as sheets of paper, magazine copies, booklets and other bindery articles wherein each mailing piece has a back edge, said articles entering the stacking machine one by one oriented the same way and having an address label attached thereto at approximately the same location on each article, said apparatus comprising a stacking chamber for receiving said articles, first and second conveying means each having an inlet and an outlet, said first and second outlets each associated with a respective opposite side of said stacking chamber, a shift member adapted for diverting predetermined number of articles to either said inlet of said first conveying means or said inlet of said second conveying means, and a selector means for initiating removal of a pile of articles collected in said stacking chamber, the improvement comprising: means for driving said first and second conveying means at the same conveying speed, said conveying means including uninverted conveying parts for the articles conveyed there along, so that each article conveyed along the first conveying means will be delivered to the stacking chamber with its address label turned downwards and have its back edge facing away from said first outlet, and so that each article conveyed along the second conveying means will be delivered to the stacking chamber with its address label turned upwards and have its back edge facing away from the second opposite outlet, and the improvement further comprising: a detector means and a control unit, the shift member and the selector means being connected to the control unit for the operation of said shift member and said selector means in response to signals which are generated by the detector means, said detector means being positioned to detect pertinent code data associated with a data bank containing all the address data of the address labels, so as to operate said shift member in response to a first set of code data combinations for thereby stacking articles in batches comprising a selected number of articles all oriented the same way, and so as to operate said selector means in response to a second set of code data combinations for thereby removing a pile composed of a plurality of batches.

11. An apparatus for stacking individual pieces for printed matter for mailing such as sheets of paper, magazine copies, booklets and other bindery articles wherein each mailing piece has a back, said apparatus comprising:

a. a data-processing means for processing address indentification data and storing same on a record medium, said data-processing means being programmed so as to collect addresses belonging to the same postal code or zip code in batches, the batches being identified by means of code symbols determined by the number of addresses belonging to the same batch, b. an addressing machine positioned to apply said address indentification data onto individual mailing pieces which pass said addressing machine in a row wherein each piece has its front page and the back edge oriented in the same way, c. a stacking machine comprising an infeed conveyor adapted for transporting said row of addressed mailing pieces from said addressing machine, said stacking machine further comprising means for changing the orientation of said mailing pieces so as to stack the mailing pieces in batches comprising a selected number of pieces, wherein the copies of each batch have their address label and back oriented the same way, but oppositely of the address labels and the backs of the pieces in an underlying batch, and said stacking machine also comprising a selector means for initiating removal of a full pile composed of a plurality of batches, d. detector means positioned to detect main symbols on said record medium, said detector means upon detection of a first set of combinations of said symbols generating signals for initiating operation of said shift member to form said batches of pieces, and said detector means upon detection of a second set of combinations of said symbols initiating operation of said selector means for removal of said full pile of pieces.

12. An apparatus for addressing and stacking individual pieces of printed matter for mailing, such as sheets of paper, magazine copies, booklets and other bindery articles wherein each mailing piece has a back, said apparatus comprising:

a. a data-processing means with a printer for printing the addresses on continuous stationary, said data-processing means being programmed so as to print the addresses in columns, addresses belonging to the same postal code or zip code being collected in batches, and so as to print symbols on said address stationary, the position of said symbols being dependent upon the number of addresses belonging to the same batch, b. an addressing machine, said machine continually guillotining said printed stationary into strips comprising one address from each column, and separating each said strip into individual address labels for thereafter applying the labels one by one on individual mailing pieces which pass said label addressing machine in a row wherein each piece has the address label and the back oriented in the same way, c. a stacking machine comprising an infeed conveyor adapted for transporting said row of addressed mailing copies from said addressing machine, said stacking machine further comprising means for changing the orientation of said mailing pieces so as to stack the mailing pieces in batches comprising a selected number of pieces, so that copies of each batch have their backs and their address labels oriented the same way, but oppositely of the backs and the address labels of the pieces in an underlying batch, and said stacking machine also comprising a selector means for initiating removal of a full pile composed of a plurality of batches, d. detector means provided in the vicinity of said label addressing machine and operable to detect said symbols on said address stationary, said detector means upon detection of a first combination of said symbols generating signals for initiating operation of said shift member to form said batches of pieces, and which upon detection of a second combination of said symbols initiating operation of said selector means.

13. An apparatus as claimed in claim 12, wherein said detector means includes a number of readers corresponding to the number of columns of addresses on said stationary plus one.

14. An apparatus as claimed in claim 13, wherein the readers are positioned so as to scan the intermediate areas between said columns and the edge areas outside the columns, said columns and the edge areas outside the columns, said symbols being printed in said intermediate areas and the edge areas, thereby not being disturbed by the characters representing the addresses.

15. An apparatus as claimed in claim 14, wherein a first edge reader and any intermediate readers detect first symbols representing the number of mailing pieces which are to form batches in which the pieces have their backs and their address labels oriented in the same direction, the detection of such first symbols giving rise to a signal-initiating operation of said shift member, whereas a second edge reader detects symbols which, when appearing together with the symbols detected by said first edge reader or any of the intermediate readers, give rise to a signal-initiating operation of said selector means for initiating removal of a full pile.

* * * * *